United States Patent [19]

Zipf et al.

[11] Patent Number: 4,703,595

[45] Date of Patent: Nov. 3, 1987

[54] COUPLER FOR HANGING PRECAST CONCRETE PANELS FROM A HOIST

[75] Inventors: Eckart Zipf, Schlüchtern, Fed. Rep. of Germany; Marcel Arteon, Paris; Patric Verde, Argenteuil, both of France

[73] Assignee: Dr. Ing. Ernst Haeussler, Essen, Fed. Rep. of Germany

[21] Appl. No.: 803,574

[22] Filed: Dec. 2, 1985

[30] Foreign Application Priority Data

Nov. 30, 1984 [DE] Fed. Rep. of Germany ..... 3443753
Jul. 31, 1985 [DE] Fed. Rep. of Germany ..... 3527318

[51] Int. Cl.[4] ..... E02D 35/00; B66C 1/66

[52] U.S. Cl. ..... 52/125.4; 52/125.2; 294/89

[58] Field of Search ..... 52/125.4, 125.5; 294/90, 83 R, 89

[56] References Cited

U.S. PATENT DOCUMENTS

| | | | |
|---|---|---|---|
| 3,499,676 | 3/1970 | Haeussler | 294/90 |
| 3,861,106 | 1/1975 | Erhart | 52/125.4 |
| 3,883,170 | 5/1975 | Fricker et al. | 294/83 R |
| 4,087,947 | 5/1978 | Turner | 52/125.4 |
| 4,173,367 | 11/1979 | Haeussler | 294/90 |
| 4,262,951 | 4/1981 | Hoyer | 52/125.4 |
| 4,296,909 | 10/1981 | Haeussler | 52/125.4 |
| 4,368,914 | 1/1983 | Truitt et al. | 294/89 |
| 4,398,762 | 8/1983 | Haeussler et al. | 294/89 |
| 4,437,642 | 3/1984 | Holt | 52/125.4 |
| 4,615,554 | 10/1986 | Schilla et al. | 294/89 |

FOREIGN PATENT DOCUMENTS

| | | | |
|---|---|---|---|
| 1800807 | 9/1970 | Fed. Rep. of Germany | 52/125.4 |
| 1684278 | 3/1971 | Fed. Rep. of Germany | 52/125.4 |
| 2223519 | 11/1973 | Fed. Rep. of Germany | 52/125.4 |

*Primary Examiner*—William F. Pate, III
*Assistant Examiner*—Michael Safavi
*Attorney, Agent, or Firm*—Karl F. Ross; Herbert Dubno

[57] ABSTRACT

A coupler for hanging a prefabricated concrete body on a hoist. The connecting hook member has an arcuate slot and is provided on one end with an entrance opening for the slot, in which the connecting bolt head of an anchor bolt can be inserted. The connecting hook member is constructed as a hemispherically shaped component, on whose top side a hook pivot eye is attached, which is engaged pivotally with the suspension shackle in the shackle pivot eye. On the one side of the hook pivot eye the entrance opening formed as a mouth of the slot is positioned on the top side of the hemispherically shaped component. On the other side of the hook pivot eye the operating lever is positioned extending substantially radially. The hook pivot eye may be positioned in the plane of the slot. In this case the operating lever reaches a limit of its motion by contact with the bridging member of the suspension shackle. The hook pivot eye may however also be oriented perpendicularly to the slot.

1 Claim, 12 Drawing Figures

COUPLER FOR HANGING PRECAST CONCRETE PANELS FROM A HOIST

FIELD OF THE INVENTION

Our present invention relates to a coupler for hanging, i.e. suspending, picking up and conveying prefabricated concrete bodies, such as panels, and, more particularly, to a coupler for engagement with a pin embedded in a body and adapted to be supported by a rope or cable of a hoist.

BACKGROUND OF THE INVENTION

A coupler for a hoist can engage an anchor bolt having a shaft and a connecting bolt head, this anchor bolt being embedded in the precast concrete part, e.g. a prefabricated panel, and a spherically shaped connecting hook member engageable with the anchor bolt and from which an operating lever projects and which has a directly or indirectly pivotally connected suspension shackle connected to the hoist. The spherically shaped hook member has a circular slot which fits the connecting bolt head and is provided at one end with an entrance opening through which the bolt head of the anchor bolt embedded in the concrete can be inserted.

In a known coupler of this type, as taught in German Pat. No. 30 12 280 the connecting hook member, when seen in a view orthogonal to the plane of the slot, is a completely spherical component with an operating arm or lever extending from it.

At the center of this completely spherical component a hole receives the suspension shackle which is suspended with its pivot eye pivotally connected therewith.

The hole runs perpendicular to the plane of the slot. The structure and arrangement of the components is such that the connecting bolt head of the anchor bolt embedded in concrete is guided into the entrance opening of the connecting hook member when its operating lever is approximately horizontal and rests on the prefabricated concrete body. The operating lever or arm is pivotable from this entering position through about 180° into a locking position.

The suspension shackle is constructed as a bridging shackle, whose bridge member separates a pivot eye from a suspension eye. In taking the load the suspension shackle by way of the bridging member engages the operating lever to ensure that the connecting hook member will be in the locked position.

Kinematically the process is reversed on releasing the concrete body. While this arrangement has been successfully used we have found that for simpler fabrication, more convenient operations, and improved reliability, some modification of the structure is highly desirable.

OBJECTS OF THE INVENTION

The principal object of our invention is to provide a coupler of the kind described but with a simpler structure, greater operation ease, better reliability, and facilitated fabrication.

It is a general object of our invention to provide an improved coupler for hanging prefabricated concrete bodies especially building panels from a hoist.

It is also an object of our invention to provide an improved coupler for suspending such prefabricated concrete structures, and the like from a hoist cable which is simpler than prior-art couplers.

SUMMARY OF THE INVENTION

These objects and others which will become more apparent hereinafter are attained in accordance with our invention in a coupler for suspending a prefabricated concrete body on a hoist and engageable with an anchor bolt having a shaft and a connecting bolt head, this anchor bolt being embedded in the prefabricated concrete body. The coupler comprises a generally spherically curved connecting hook member from which an operating lever protrudes and which has a suspension shackle pivotally connected thereto which provides the lift and is connected with the hoist. The connecting bolt member has an arcuate slot which fits the shape of and engages beneath the connecting bolt head and is provided at one end of the connecting hook member with an entrance opening through which the connecting bolt head of the anchor bolt can be inserted.

According to our invention the connecting hook member is formed as a generally hemispherically shaped component as seen in a view orthogonal to the plane of the slot, on whose top side a hook pivot eye is formed, in which a suspension pivot eye of the suspension shackle is swingably engaged so that the hemispherically shaped component is hung therefrom. On one side of the hook pivot eye the entrance opening, formed as a mouth of the slot, is provided on the top side of the hemispherically shaped component while on the other side of the hook pivot eye the operating lever is attached to the hemispherically shaped component extending substantially radially therefrom.

The "top side" of the generally hemispherical hook is the upper part thereof with the coupler mounted on the hoisting device with the load suspended therefrom.

Preferably the top side of the hemispherically shaped component has an inverted ridge or a valley shape, so that it allows the axis of the hook pivot eye to be positioned sufficiently close to the centerpoint of the hemispherically shaped component. In another embodiment of our invention the hook pivot eye is positioned in the plane of the slot and has its pivot eye axis positioned above the centerpoint of the hemispherically shaped component, and the hemispherically shaped component by the force of gravity as well as by the drawing force of the load is moved into the locked position by the pulling force of the hoisting device. The centerpoint is here the center of the sphere corresponding to the hemispherically shaped component. Note that the center of gravity of the hemispherical hook lies on the side of this hook opposite that at which the slot opens so as to swing the hook by gravity into the locked position.

In this way it is possible to guarantee a locking motion which is twofold, on the one hand from the previously described interplay of forces, on the other hand by the operating lever on account of its interaction with the bridging member, when according to a further preferred embodiment of our invention the suspension shackle is constructed as a bridging shackle, whose bridging member, as described above, separates a suspension eye and the shackle pivot eye connected with the hemispherically shaped component. The hemispherically shaped component with its operating lever is limited in its motion by contact against the bridging member and the suspending shackle over the bridging member. Advantageously the slot is suitably closed on the side of the hemispherically shaped component having the operating lever. While a hemispherical shape has been described it should be noted that this includes a configuration in which opposite lateral surfaces parallel to the plane of the slot are flattened or truncated.

According to another aspect of the invention the pivot eye plane of the hook pivot eye is oriented perpendicular to the plane of the slot, and on the top side of the hemispherically shaped component the hook pivot eye is directly attached. While the slot on the other side adjacent the hook pivot eye is closed, the entrance opening for the connecting bolt head formed as a mouth of the slot is positioned on the one side of the hook pivot eye previously mentioned.

According to another feature of our invention the top side of the hemispherically shaped component is provided with a ridge shape as seen in the direction of the pivot eye plane, where on the ridge peak of the top side the pivot eye is attached extending radially.

The hook pivot eye can in this case be formed together with the hemispherically shaped component, for example, cast with it or formed in a forging die therefrom.

It is also possible to weld the pivot eye to the hemispherically shaped component. In the vicinity of the closed top side the operating lever can be attached to the hemispherically shaped component, and can be formed to receive a drawing means e.g. a rope or cable, and of course corresponds to the operating lever previously mentioned.

The advantages of our invention include simplicity of manufacture. The hemispherically shaped component with the connected elements, namely the hook pivot eye and operating arm, can easily be made in a forging die, accordingly allowing the slot to be formed for engaging and gripping in an easy way. The corresponding work tool for this given shape can be easily inserted from the top side of the hemispherically shaped component. Additional steps for making an entrance opening are not necessary.

Reliability is also improved because the engaged pulling force or load secures the locked position with the prefabricated concrete body loaded on the coupler, while in the embodiment with the bridging shackle the operating lever acts to secure locked position.

BRIEF DESCRIPTION OF THE DRAWING

The above and other objects, features, and advantages of our present invention will become more readily apparent from the following description, reference being made to the accompanying drawing in which.

Figure 1:
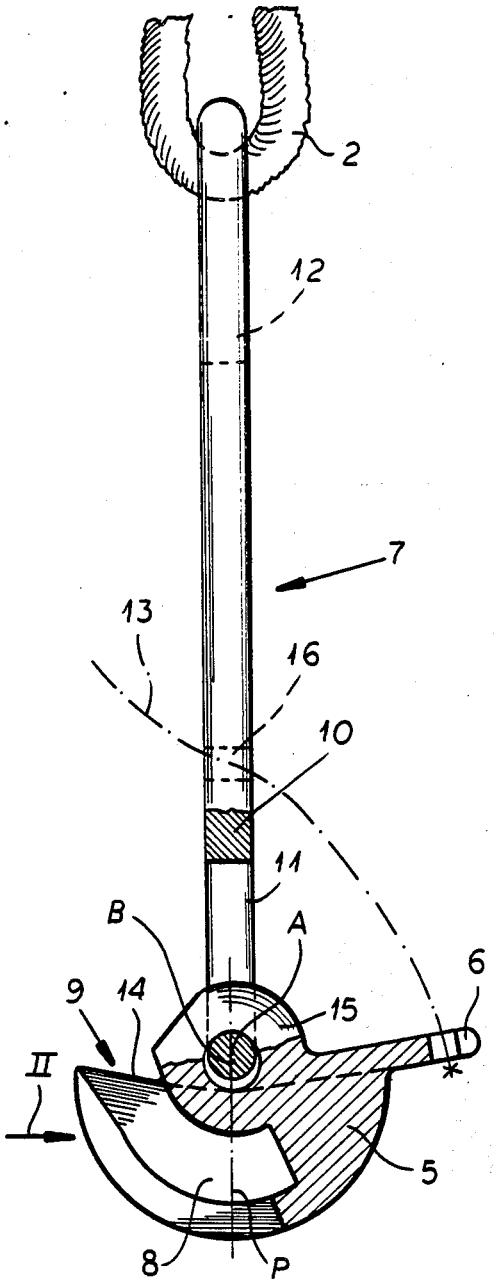
FIG. 1 is a longitudinal side cross sectional view of a preferred embodiment of a coupler according to our invention as seen in a direction perpendicular to a slot therein.
Figure 4:
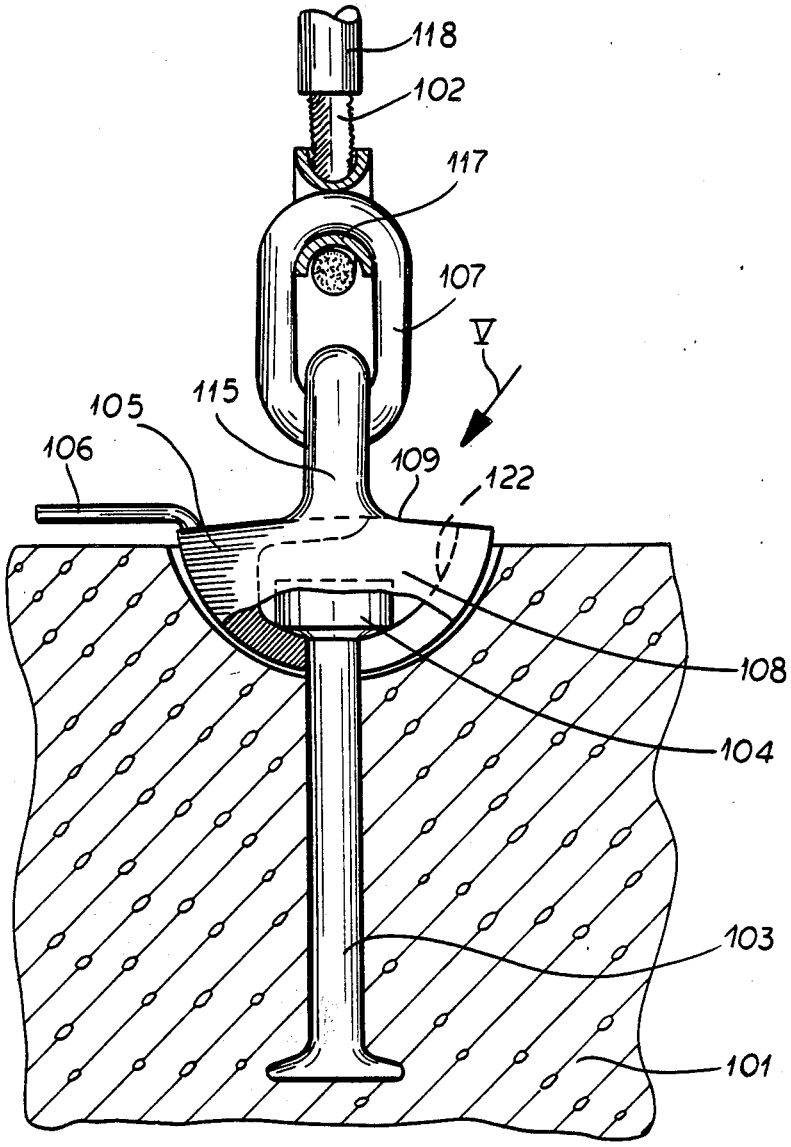
Figure 5:
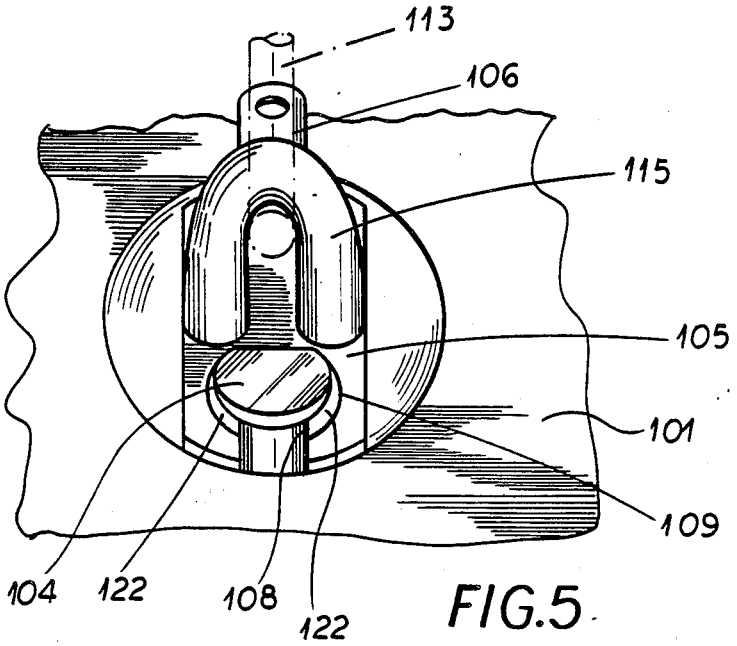
Figure 6:
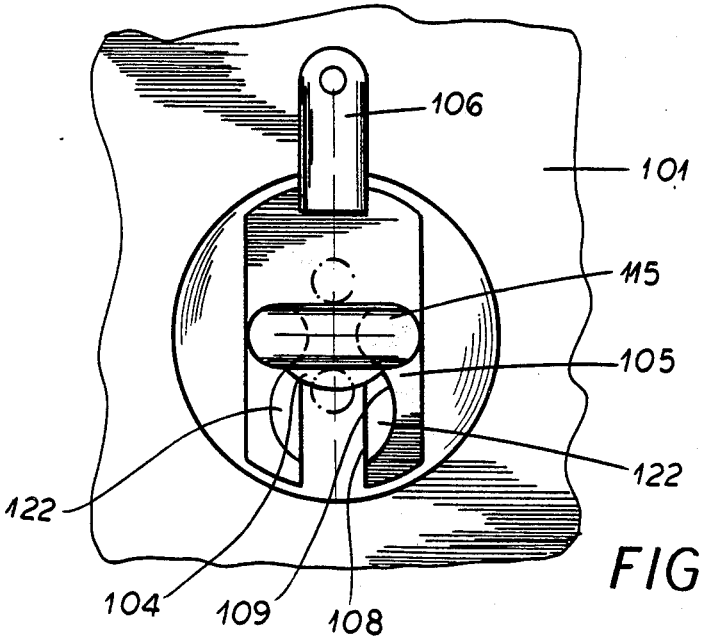
Figure 7:
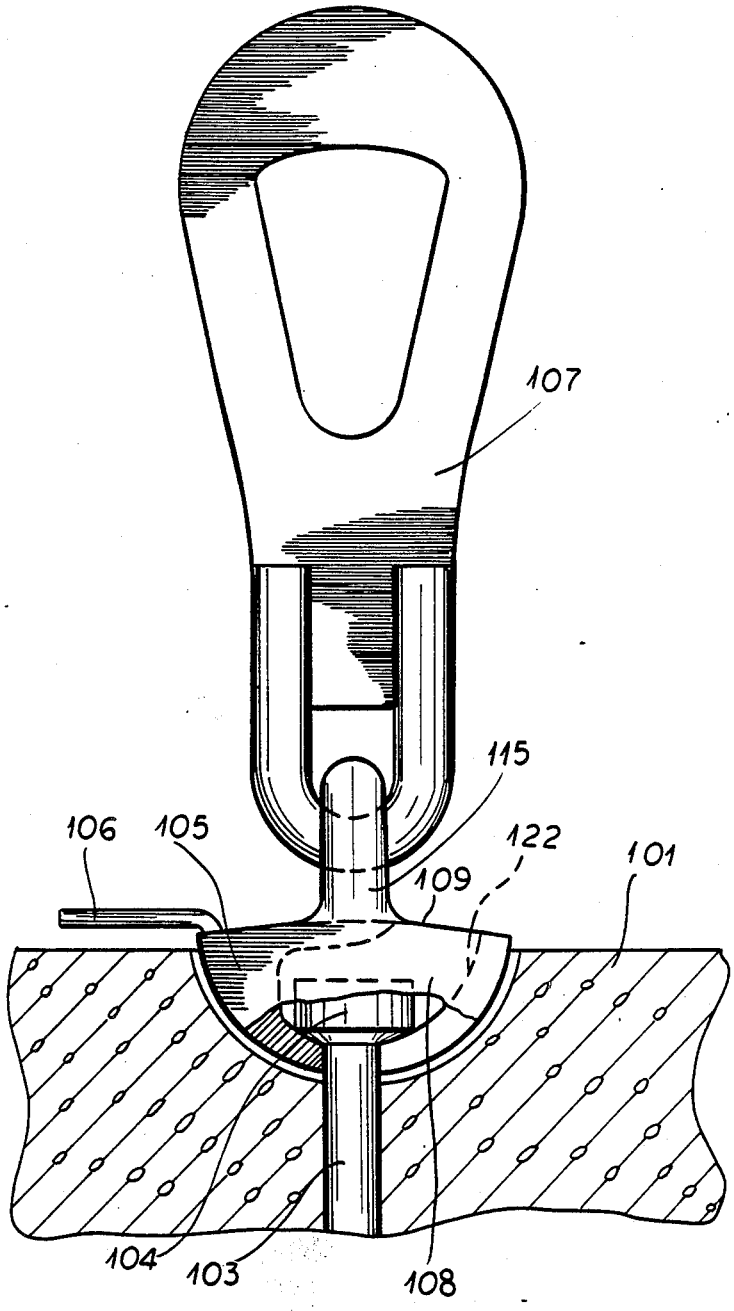

FIGS. *3a*, *3b*, and *3c* are cross sectional views of the apparatus of FIG. 1 attached to a concrete body, block or the like in successive states of operation;

FIG. 4 is a side partially sectional view of another embodiment of a coupler according to our invention attached to a steel and prefabricated concrete body as seen in the direction of the plane of the hook pivot eye;

FIG. 5 is a perspective view of the apparatus of FIG. 4 as seen in the direction of arrow V;

FIG. 6 is a top view of the apparatus of FIG. 4;

FIG. 7 is an elevational view of another embodiment of the apparatus of FIG. 4 which has a modified suspension shackle, partly broken away; and FIGS. *8a*, *8b*, and *8c* are cross sectional views of the apparatus of FIGS. 4 and 7 in different positions as it is being attached to a concrete panel.

SPECIFIC DESCRIPTION

Figure 2:
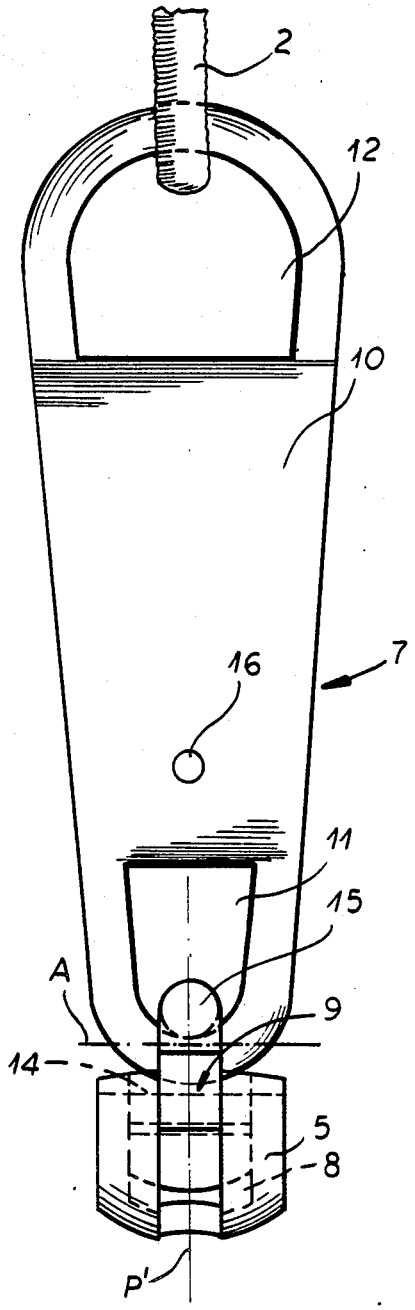
FIG. 2 is a front view of the apparatus of FIG. 1 as seen from the direction of arrow II of FIG. 1.

The preferred embodiment of the coupler shown in FIGS. 1 to 3 is used to attach and hold a prefabricated concrete body or panel 1 on a hoisting device 2, of which only a cable end having a loop for hanging the coupler is shown in the drawing.

The coupler basically comprises an anchor bolt embedded in the concrete of the prefabricated concrete body or block 1 having a shaft 3 and a connecting bolt head 4, and a connecting hook member 5 connectable to the connecting bolt head 4, from which an operating lever 6 protrudes and which has a suspension shackle 7 connected jointly thereto for attachment to the lifting or hoisting device 2.

The connecting hook member 5 has a circular slot 8 which fits the shape of the connecting bolt head 4 and is provided at one end of the connecting hook member 5 with an entrance opening 9 for slot 8. The connecting bolt head 4 of the anchor bolt embedded in the concrete is insertable into this entrance opening 9 when the connecting hook member 5 is suitably oriented, as is shown in FIGS. *3a–3c*.

The suspension shackle 7 is constructed as a bridging shackle, whose bridging member 10 separates a shackle pivot eye 11 from a suspension eye 12. The arrangement of components and structure is such that the connecting hook member 5 with its operating lever 6 finds a limit to or stop for its motion at the bridging member 10 and with the prefabricated concrete piece 1 deposited with the suspension shackle 7 standing upright, the connecting hook member 5 is movable together with the readjusted suspension shackle 7 from a locked position by a connected traction cable 13 from a vertical position of the suspension shackle 7 into the entering position and thus to the released position, and next to the limit of its motion at the bridging member 10. This too is shown in detail by comparison of FIGS. *3a–3c*.

It is understood that on insertion of the connecting bolt head 4 into the entrance opening 9 and into the circular slot 8 and in taking the load the above described interrelated steps occur in almost exactly reversed sequence, whereby the connecting hook member 5 moves into its locked position.

From a comparison of FIGS. 1 and 2 it can be seen that the connecting hook member 5 as seen in a direction orthogonal to the plane of the circular slot is constructed as a hemispherically shaped component 5, on whose top side 14 a hook pivot eye 15 positioned in the plane of the circular slot 8 is attached, in which the suspension shackle 7 engages with its shackle pivot eye 11.

On one side of the hook pivot eye 15 the entrance opening 9 is formed as the mouth of the slot 8 in the top side 14, so that special drilling is not required for the entrance opening 9.

On the other side of the hook pivot eye 15 the operating lever 6 is positioned, which extends essentially radially.

The hemispherically shaped component 5 has in this example an inverted ridge shaped or valley-shaped top side 14. The arrangement is usually such that the hook pivot eye 15 has its eye axis above the centerpoint of the hemispherically shaped component 5 (the center of the sphere) and so that the hemispherically shaped component 5 is movable by the force of gravity as well as the pulling force into the locked position. The operating lever 6 contributes its weight under the influence of gravity.

The slot 8 is closed on the side of the hemispherically shaped component 5 at which the operating lever 6 is provided. From FIG. 2 one sees that the hemispherically shaped component 5, as seen in the direction of the plane in which the slot 8 lies, is flattened on both of its lateral sides. The hemispherically shaped component 5 itself including the hook pivot eye 15 and the operating lever 6 is made in a forging die, while the slot 8 can be later machined therein or precast or forged therein.

Figure 3C:
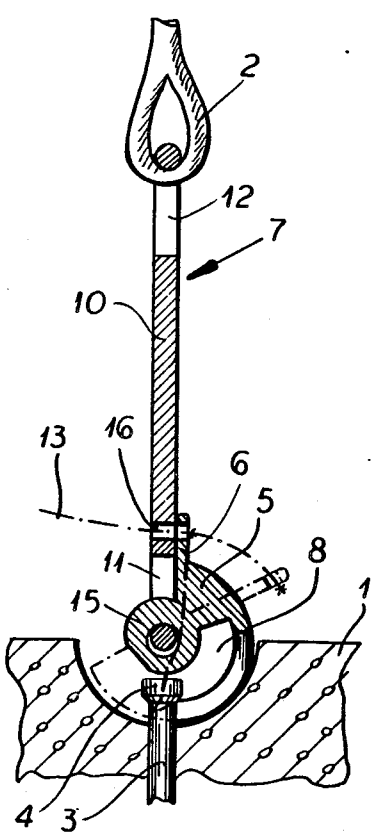
Figure 3B:
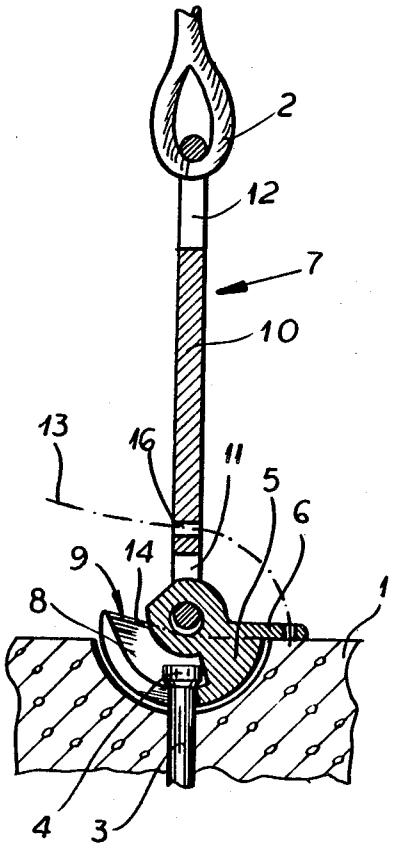
Figure 3A:
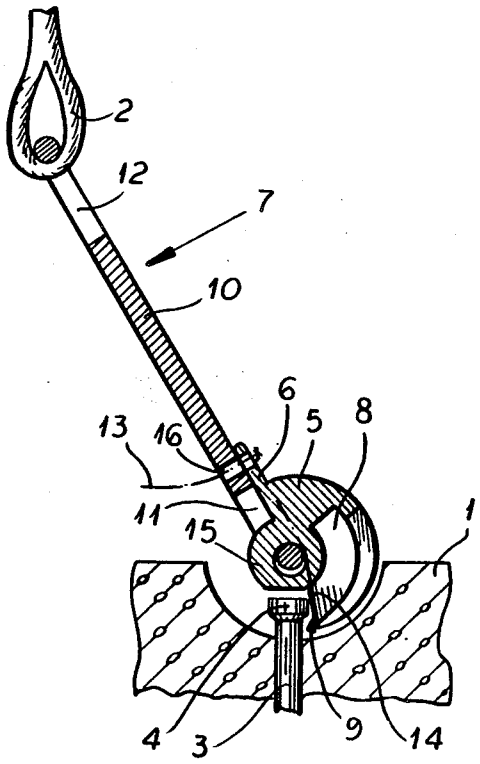

In FIG. 3*a* the relationships on inserting the connecting bolt head 4 of the anchor bolt into the entrance opening 9 of the slot 8 with the prefabricated concrete body 1 in place are shown. The hemispherically shaped component 5 is oriented as shown. The connecting bolt head 4 is in front of the entrance opening 9 which is formed by the mouth of the slot 8 in the top side 14 of the hemispherically shaped component 5.

The suspension shackle 7 is oriented so that it is slanted upward and to the left, the operating member 6 contacting on the bridging member 10 of the suspension shackle 7.

The suspension shackle 7 next moves into a vertical position, so that the connecting bolt head 4 of the anchor bolt engages into the slot 8. The shaft 3 of the anchor bolt projects from the slot 8.

Next the load is taken up by the hoisting device 2, so the hemispherically shaped component 5 moves under the influence of the load into the position shown in FIG. 3*b*.

The arrangements and structures are such that this motion of the hemispherically shaped component 5 also occurs under influence of the force of gravity, when the hemispherically shaped component 5 hangs with its hook pivot eye 5 loose in the shackle pivot eye 11 of the suspension shackle 7. That results from the distance or clearance between the axis of the hook pivot eye 15 and the centerpoint of the hemispherically shaped component 5. Usually the weight of the operating lever 6 should additionally be a help as well as the fact that the hemispherical component 5 is closed on the side of the hook pivot eye 15 lying opposite to the entrance opening 9, thereby shifting the center of gravity to the right.

FIG. 3*c* shows what occurs after the prefabricated concrete body 1 is put down. The drawing means 13 engages the operating lever 6, which is guided in this embodiment through a particular hole 16 in the bridging member 10 of the suspension shackle 7. One pulls on this drawing means 13, so that the hemispherically shaped component 5 is pivoted, which pulls it from and releases the anchor bolt.

FIG. 3*c* shows an intermediate position in broken lines, in which the operating lever 6 does not yet contact on the bridging member 10 of the suspension shackle 7. It remains in the drawn-out position so that in operation by further pulling on the drawing or pulling means 13 the suspension shackle 7 is pivoted to the left until in the position shown in FIG. 3*a* or outward and upward over the connecting bolt head 4 and subsequently free of the connecting bolt 4 and the anchor bolt.

In FIGS. 1 and 2 the axis of the pivot between the shackle and the eye of the hemispherical member is shown at A and the centerpoint of the hemisphere at B. The plane P of the axis and the centerpoint (FIG. 1) is perpendicular to the plane P′ of the slot.

In FIGS. 4 to 8 the hemispherically shaped component 105 has a bow-shaped slot 108 with an entrance opening 109 for the connecting bolt head 104. The anchor bolt is guided with its shaft 103 into the slot 108.

The connecting bolt head 104 is engaged or gripped from below on both sides by the slot sides 122 bordering the slot 108, and is guided on these.

The hook pivot eye 115 sits with the plane of its eye oriented perpendicular to the slot 108, as can be seen from a comparison of FIGS. 4 and 7. The suspension shackle 107 is in this specific embodiment a chain link member.

FIGS. 4 and 7 show that the hook pivot eye 115 is directly mounted on the top side of the hemispherically shaped component 105. The slot 108 is closed on the side adjacent operating handle 106. The entrance opening 109 for the connecting bolt head 4 corresponds to the mouth of the slot 108 on the other side of these hook pivot eye 115.

FIGS. 4 to 7, 8*a* to 8*c* also show that the hemispherically shaped component 105 has as viewed in the plane of the hook pivot eye 115 a ridge shaped top side, and on the ridge peak the hook pivot eye 115 is mounted.

The hook pivot eye 115 can be formed on the hemispherically shaped component 105 or welded thereon.

FIG. 4 indicates that an operating lever 106 for connection to a drawing means (not shown) is attached to or formed on the hemispherically shaped component 105 on its top side.

FIGS. 5 and 6 reveal that the hemispherically shaped component 5 is flattened on its opposite sides running parallel to the plane of the slot 8. However it can also be constructed as a completely hemispherical component 105.

Figures 8A, 8B, 8C:
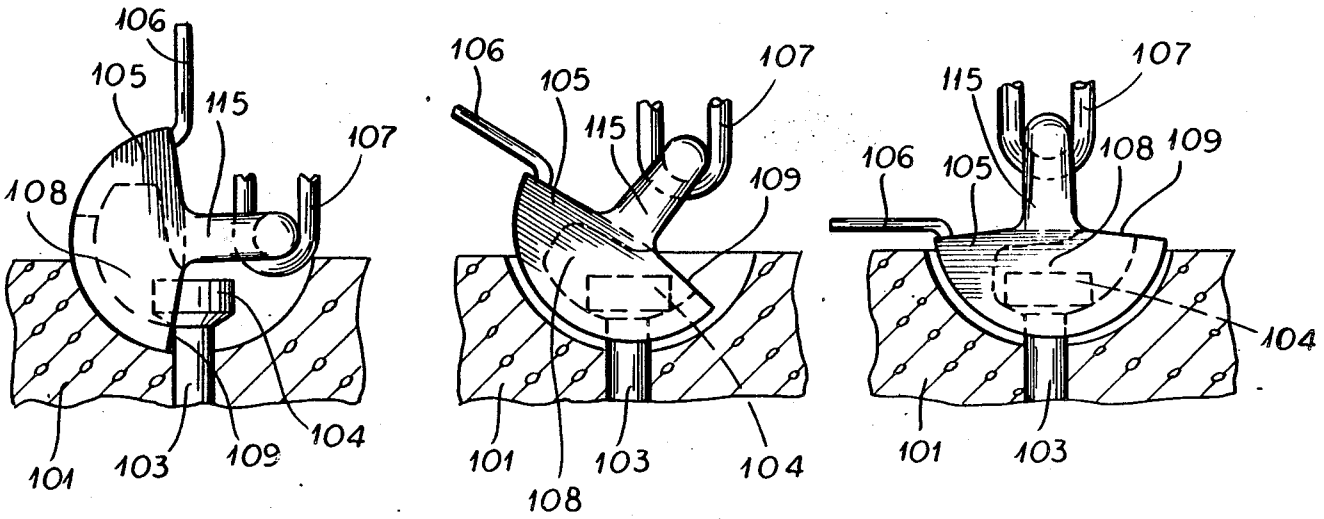

FIGS. 8*a*, 8*b*, and 8*c* show several operational positions, namely setting of the hemispherically shaped component 105 pivoted about 90° with the entrance opening 109 set adjacent the connecting bolt head 104, pivoting of the hemispherically shaped component 105 into a position, in which the connecting bolt head 104 can no longer be released from the slot 108, and a lifting position for the prefabricated concrete body 101, wherein FIG. 8*c* agrees with FIG. 4.

Upon passage of the connecting bolt head 104 into the entrance opening 109 the hemispherically shaped component 105 is positioned with the first half of the hemispherically shaped component 105 adjacent the connecting bolt head 104 of the transporting bolt embedded in the concrete, so that it is possible to guide it onto the bolt without difficulty.

The hoisting device 102 can comprise a cable or rope and can be attached to a chain link member 107 like a suspension shackle with a cable rope eye 117 and a tightening jacket 118, as is shown in FIG. 4.

The possibility also exists to provide an additional suspension shackle 117, as is illustrated in FIG. 4. It is pivotable in all directions in the chain link member. This provides a particular operational advantage, when the hook pivot eye 115 is comparatively small.

We claim:

1. A hook for engagement with a bolt anchored in a concrete body and having a bolt head projecting therefrom, the hook comprising:

a generally hemispherical member having a generally flat top side and a downwardly part-spherically convex bottom side having a radius of curvature with a centerpoint of said curvature generally at the top side, the member being formed with an arcuate slot having one end open at the top side of said member for engagement with the head of the bolt anchored in said body and an opposite closed end;

an eye formed on said top side of said member generally between the slot ends and defining a pivot axis which defines a plane with the centerpoint, the slot traversing the plane with its ends extending to opposite sides thereof;

a suspension shackle swingably received in said eye and connected to a hoist, the member being pivotal about the axis on the shackle; and a handle formed on said top side of said member extending generally radially therefrom on a side thereof opposite the open end of the slot, said slot lies in a plane parallel to a plane of said shackle and perpendicular to said axis said shackle having an oblong shape with said shape lying in said plane of the shackle.

* * * * *